US008061332B1

(12) United States Patent
Harbert

(10) Patent No.: US 8,061,332 B1
(45) Date of Patent: Nov. 22, 2011

(54) FUEL RAIL AND WIRING HARNESS MANAGEMENT ASSEMBLY

(76) Inventor: Richard H. Harbert, Mukilteo, WA (US)

( * ) Notice: Subject to any disclaimer, the term of this patent is extended or adjusted under 35 U.S.C. 154(b) by 621 days.

(21) Appl. No.: 12/259,804

(22) Filed: Oct. 28, 2008

Related U.S. Application Data

(60) Provisional application No. 60/983,346, filed on Oct. 29, 2007.

(51) Int. Cl.
*F02B 77/00* (2006.01)
*F02M 55/02* (2006.01)

(52) U.S. Cl. ..... 123/469; 123/195 C

(58) Field of Classification Search ..... 123/195 C, 123/198 E, 90.37, 468, 469
See application file for complete search history.

(56) References Cited

U.S. PATENT DOCUMENTS 6,817,337 B1 * 11/2004 Siring et al. ..... 123/469

OTHER PUBLICATIONS http://en.wikipedia.org/wiki/Fuel_rail.

* cited by examiner

*Primary Examiner* — Noah Kamen
(74) *Attorney, Agent, or Firm* — Innovation Law Group; Jacques M. Dublin

(57) ABSTRACT

A robust, combined fuel rail and wiring harness shield assembly, for each bank of cylinders of an IC engine, comprising a rectangular multi-planar plate having an integral longitudinal mid-rib on one side, longitudinally bored as a fuel distribution manifold to EFI injectors mounted in generally angled bores spaced along the rib. In cross-section the assembly is generally T-shaped, and is preferably constructed of extruded aluminum. Flanking each side of the mid-rib are wings, one of which includes an angled flange. The mid-rib, wing and associated flange form a wiring management channel. The flange is angled down at approximately 135° on the outboard side of the cylinder bank so that it points vertically downwardly. In operation, assembly pairs are connected to a flexible fuel inlet line in series or parallel, with one (series plumbed) or both (in parallel plumbed systems) assembly longitudinal bores having a threaded plug at the distal end.

16 Claims, 6 Drawing Sheets

FUEL RAIL AND WIRING HARNESS MANAGEMENT ASSEMBLY

CROSS-REFERENCE TO RELATED APPLICATION

This application is the US Regular Application corresponding to U.S. Provisional Application by the same inventor filed under the same title on Oct. 29, 2007 as U.S. Ser. No. 60/983,346, the benefit of the filing date of which is hereby claimed under 35 US Code §§119, 120, ff, and the text and Figures of which are hereby incorporated by reference to the extent needed for support under 35 US Code §112.

FIELD

The invention relates to engine technology, and more particularly to fuel rails and wiring harness management assemblies for Electronic Fuel Injection of the Distributorless Ignition System (DIS) type, comprising a multi-planar elongated plate having a depending mid-rib that is bored for fuel supply along a bank of cylinders of an internal combustion engine, and which includes spaced bores along the mid-rib that engage and supply fuel to fuel injectors. In addition, the plate flanges flanking the rib function to shield wiring harness leads to the EFI injectors of the engine.

BACKGROUND

Over the past 50 years of automotive engineering, fuel injection has become the dominant system for mixing fuel with air for combusition in the engine cylinders. Early systems in the mid-1950's were mechanical in nature, but were supplanted in the 1960's and 1970's with various types of Electronic Fuel Injection, in large part due to the ability of EFIs to better achieve stoichiometric engine operation which reduced engine pollution. The closed loop systems introduced in the 80's improved the air/fuel mixture control by feed-back from an oxygen sensor located in the engine exhaust. Since that time, EFIs have continued to evolve and become more reliable, and except where there are no strict emission regulations, carburetor-controlled engines are the exception.

The fuel injector dispenses fuel directly into the engine air stream, typically being located in a port a few inches upstream of the intake valve of each cylinder, or directly into the cylinder itself. While the direct injection approach was initially used for diesel engines, gasoline engines now use direct injection. Typically, injectors employ a solenoid that is normally closed, that is a tapered tip of a solenoid plunger seats against a conical valve seat. The injectors are wired to an EFI control system microprocessor, and plumbed to the fuel lines. When the solenoid is energized by a signal from the EFI/DIS controller, the plunger is retracted and fuel under pressure is injected, passing through the valve seat and through an atomizer nozzle, thereby spraying fuel into the air stream passing through the port, or spraying fuel directly into the combustion chamber portion of the cylinder. In turn, the injector is connected to a high pressure fuel line, 40-50 psi for port fuel injection and 200-250 psi for direct injection. At these pressures, the fuel lines must be much more robust than the very low pressure that had been used for venturi-fed carburetor systems. This requirement led to the introduction of "fuel rails", rigid pipes connected to a high pressure fuel line coming from the fuel tank via the high pressure fuel pump. The fuel rails are plumbed to the injectors.

Current fuel rails comprise simple exposed pipes or conduits that are cantilevered above the cylinder banks of the IC engine to which they are installed. For a V8 engine, two rails are provided, one for each bank of cylinders. They include a cross-over pipe that joins the fuel rails medially of their ends, and the inlet high pressure fuel line feeds into the cross-over pipe.

Thus, the current fuel rail design is an "H"-shape as seen in plan view from above, each of the long, vertical members representing a rail for one of the two cylinder banks, and the cross-bar representing the cross-over pipe. The fuel from the fuel pump feeds into the center of the cross-bar of the "H"-shaped design. This "H" design routes the fuel over the engine, thus presenting service technicians with a line that can be in the way of other work, and if snagged, can result in breakage of seals with attendant leakage of fuel. In addition, there is little if any flex in the cross-over pipe, so the current assembly has to be aligned with, in a V8 engine, eight spaced injectors or injector ports in both cylinder heads simultaneously, a task that is not easy.

The current type of fuel rail assembly is secured to the engine only via the injectors; that is, the injectors themselves serve as the support pillars. Bumping the rails can break the injector seals causing dangerous fuel leaks on hot engine parts during operation, in part because the rails are of low mass, and do not have sufficient inertia to absorb a bump or jostle. The net result is that the rails, the fuel line, the cross-over pipe, and the wiring from the EFI/DIS controller(s) and power supply to the injectors can come into contact with various other engine parts, and present complex, overlapping parts that must be properly routed and carefully kept clear-of during servicing.

In addition to the wiring currently being essentially loose and exposed, the insulation and its support or retainer brackets on the inner surface of the hood can come into contact with the wiring when the hood is closed, pressing down on the wiring. This can lead to two problems: First, rubbing wear on the wiring that can cause breaks or change in conductive properties of the wiring; Second, there is a potential for pressing the wiring down onto hot surfaces of the engine below the wiring. In addition, exposed wiring can become snagged during servicing.

Accordingly, there is an unmet need in the art for an assembly that protects wiring and better routes fuel lines while at the same time is robust, more massive, and attractive.

THE INVENTION

Summary, Including Objects and Advantages

The invention relates to a robust, extruded, cast or billet-type combined fuel rail and wiring harness shield assembly for a bank of cylinders of an IC engine having a Distributorless Ignition System and an Electronic Fuel Injection system. The inventive fuel rail/harness shield assembly comprises a rectangular multi-planar plate having an integral longitudinal mid-rib depending from one side that is bored both longitudinally and from below to form a fuel distribution manifold to the EFI injectors mounted in, and spaced along, the underside of the rib. In cross-section, the assembly is generally T-shaped, and is preferably constructed of aluminum extruded in the cross-sectional shape. The rectangular plate may be generally described as "wings" extending laterally from the top of the mid-rib.

The fuel rail mid-rib provides a continuous web of material between the spaced, adjacent injector mounting bores that are precision-milled at the appropriate angle, into the rib from below. This continuous mid-rib web serves to reinforce the injector mounting, making the injectors less susceptible to vibration during operation or damage during servicing. Stated another way, the injectors are mounted in the rib, rather than in the conventional assembly where the fuel rail (tube) is mounted on the injectors. The result is that the combination of the inventive fuel rail and injectors forms a more massive, more rigid assembly that is near-monolithic, and thus can better withstand vibrations in operation and bumping and jostling during servicing.

The mid-rib, seen end-on in end elevation, is generally orthogonal with respect to the wing structure, but in a particular application, i.e., for a particular engine, is canted so that its vertical center line forms an included angle with respect to a side wing on the order of from about 70°-85°. In addition, the injector bores are also canted on the order of from about 5°-20° to match the injector angle into the port or cylinder, depending on the type of EFI system the particular engine employs (port or direct injection).

Flanking each side of the mid-rib are transversely extending wings that serve to shield and manage the wiring to the injectors or/and the coils, or other wiring that may be part of the overall engine wiring harness, e.g., including sensor wires to the Powertrain Control Module that controls the EFI and DIS systems. The two side wings are different, one side wing includes an angled, full length marginal flange, and the other side wing is relatively straight. The flange is angled down, that is, toward the underside of the plate on which the rib is disposed, the included angle being approximately 135°. As mounted on a V8 engine, for example, the angle between the cylinders is on the order of 90°, and the angled flange is disposed on the outboard side of the cylinder bank so that the flange points substantially vertically downwardly.

In addition to the flanges being robust to protect the wiring, and to prevent hood insulation or other parts pressing on the wiring, the mass of the inventive fuel rail/harness protection assembly provides cooling as the flange and wings provide heat radiating function. That is they serve as cooling fins.

The inventive fuel rail/harness protection assembly fuel bore is threaded at both ends. In a first, series fueling embodiment, the assembly includes an inlet fuel line, such as a flexible, braided stainless steel-covered high pressure plastic fuel line, threaded into a first end of a first rail. At the second end of the first embodiment, a flexible cross-over line is threaded. That cross-over line threads into the second end of a second inventive fuel rail/harness protection assembly, and the first end of the second assembly is plugged. In this first embodiment, the inlet fuel line is fed into the back, or bulkhead end of the inventive assembly, and the cross-over line is at the forward end of the engine. The in-feed can be at either the right side or the left side of the engine. Since there are two inventive assemblies used in the combination for a V8 engine, the alignment is simpler. In addition, simply by changing the length of the flexible crossover line at the front of the engine, the same inventive assemblies can be used for 60° V or 90° V engines. The rail can also be easily converted to V6 by cutting off the extra injector segment of the plate and re-threading the longitudinal bore of the fuel distribution manifold. Conversely, the fuel rail extrusion may be longer to accommodate V10 or V12 engines, having cylinder banks of 5 and 6 cylinders, respectively.

In the preferred, second, parallel fueling embodiment, both first ends of the inventive fuel rail assemblies are plugged. The inlet fuel line is Tee-d into the cross-over line so that fuel is fed to both of the inventive fuel rail assemblies, one on each bank, simultaneously. In this embodiment the inlet fuel line is Tee-d in at the forward end of the engine, although it may be introduced next to the bulkhead end of the engine.

The preferred embodiment of the inventive fuel rail module calls for the injectors to be inserted in, and firmly and tightly seated in, the angularly oriented, precision milled bores in the rib, which bores intersect the longitudinal fuel channel. The output end of the injectors are first press fit into threaded holes in the air input runners (ports) going to each cylinder, or in the case of direct injection, directly into the cylinder head injector ports. Optionally, injectors are threaded into the cylinder head or the air intake manifold branch runners. Then, an inventive fuel rail module is press fitted simultaneously onto the input shanks of the injectors of a bank of cylinders. The injectors include O-ring seals, and the bores closely match the size of the injector shank. The inlet aperture of the injector is thus connected with the longitudinal bore of the inventive fuel rail module permitting high pressure fuel conduction to the injectors. This method of seating provides a near-monolithic fuel rail/multiple injector assembly that has more inertial mass that can resist and dampen vibration and shocks.

In a first, preferred embodiment of the mounting system, 2 or 3 slotted holes are provided in one wing adjacent to, but not intersecting, the mid-rib. The inventive fuel rail assembly is then bolted to the OEM bosses provided either in the head or the air intake manifold. The slots are typically oriented parallel to the longitudinal axis of the mid-rib, and they permit whatever slight fore-aft orientation adjustment as may be needed for accurate mating of the inventive fuel rail assembly to the injectors.

As an alternative mounting system, the head of the cylinder block or the air intake manifold may be provided with one or more, typically 2 or 3, spaced, generally U-shaped clips. These clips have somewhat enlarged semi-circular profiles adjacent the tops of the clip arms, that closely fit the rib contour. This permits securing the inventive fuel rail simply by aligning the injector bores over the injectors and pushing down so that the clips tightly engage the rib as the injectors slide into the bores.

Still other advantages of the inventive assembly will be evident to those skilled in the art.

BRIEF DESCRIPTION OF THE DRAWINGS

The invention is described in more detail with reference to the CAD drawings and photos, in which.

DETAILED DESCRIPTION, INCLUDING THE BEST MODES OF CARRYING OUT THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

Figures 1A, 1B:
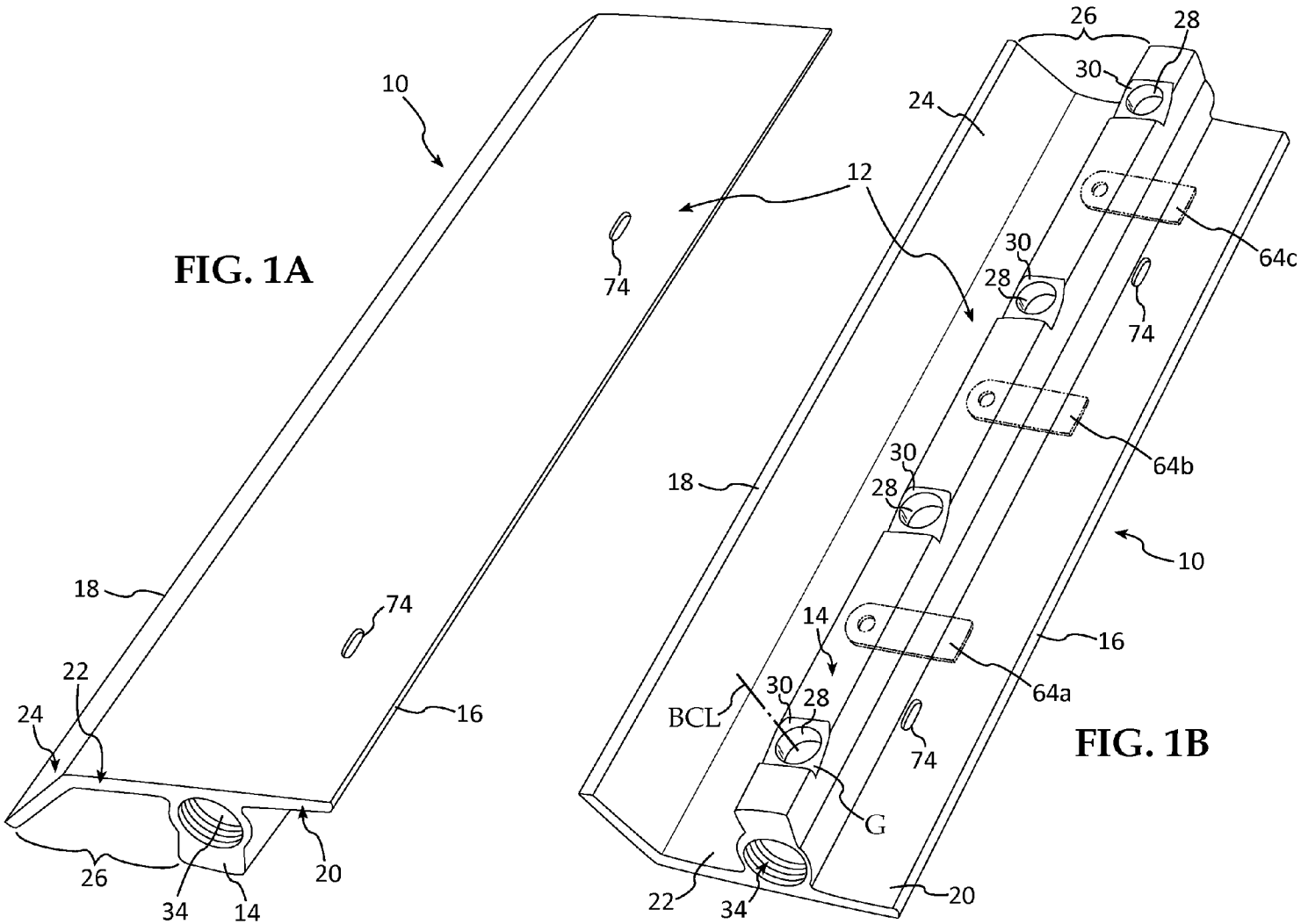
FIG. 1A is an isometric view, from a ¾ top right position, of the inventive fuel rail/harness protection assembly, the fuel feed inlet threading and the angled flange of the left wing being shown.
FIG. 1B is an isometric view of the inventive assembly of FIG. 1A that has been inverted to show the depending longitudinal mid-rib and the milled seats for the injectors, the space for the wiring between the rib and the flange being more clearly shown.

FIG. 1A is an view of a first, currently preferred, embodiment of the inventive fuel rail/harness protection assembly 10 in isometric, from the top side at a ¾ angle as designed for a 90° V8 engine. The inventive assembly 10 comprises an elongated, rectangular planar top plate 12, and a depending fuel supply rib 14 disposed generally medially between the longitudinal marginal edges 16 and 18 of the top plate 12, and extending longitudinally the length of the top plate 12. As shown in this exemplary, presently preferred, embodiment, the rib and plate are integral and made of aluminum, preferably from aluminum that is formed by extrusion, casting or machined from a billet. In the alternative, the inventive fuel rail assembly unit may be made from any high temperature resistant and robust composite plastic, such as: polycarbonate polymers and co-polymers; co-polymers or terpolymers of butadiene and styrene; high melting point nylon polymers and co-polymers; high melting point HDPE polymers and co-polymers; and the like.

Figures 2A, 2B:
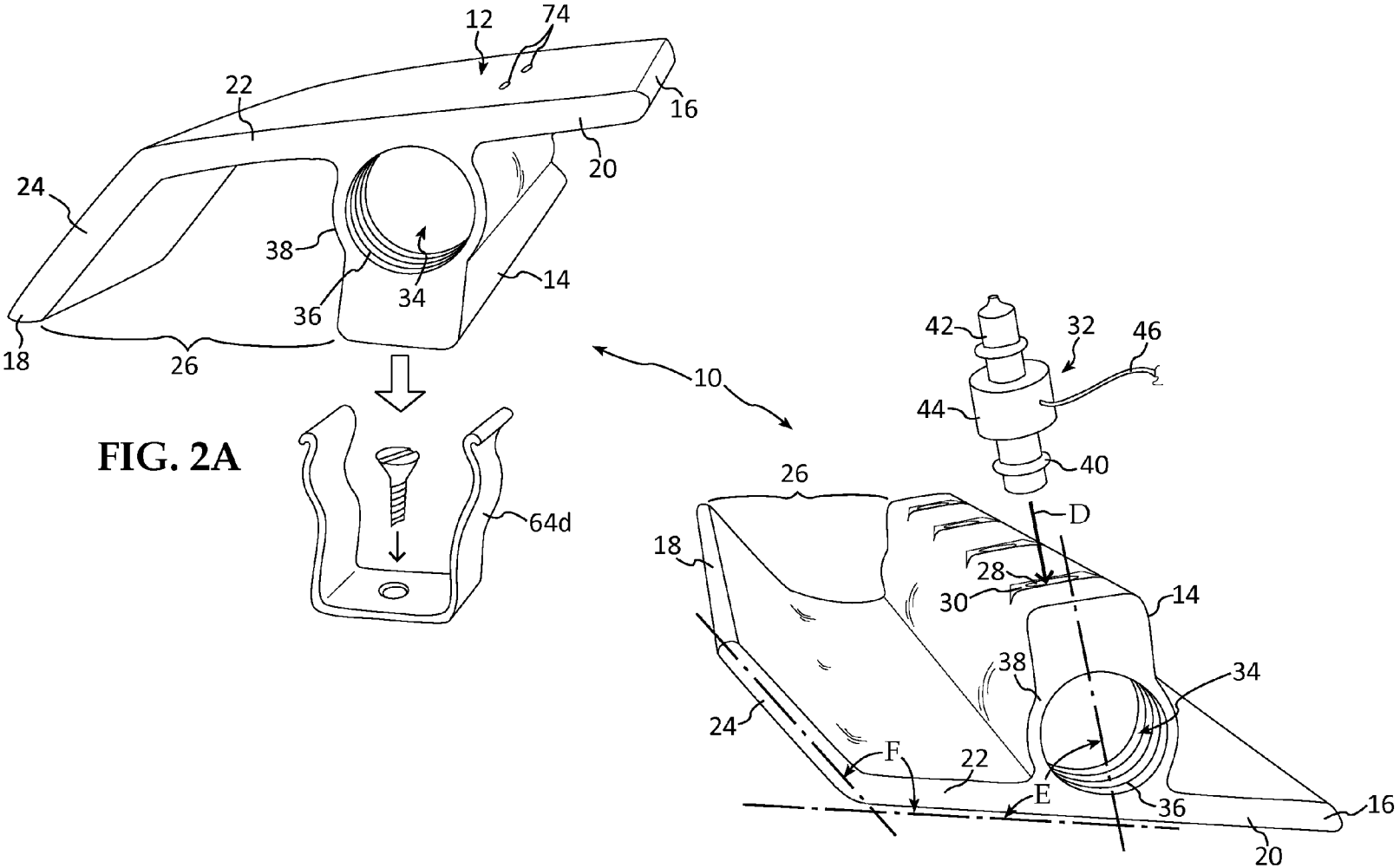
FIG. 2A is an end elevation view of the inventive assembly of FIG. 1A, slightly to the right of a straight end-on elevation view showing the profile of the plate, the wings, the angled flange and the right side of the fuel rib.
FIG. 2B is an end elevation view of the inventive assembly of FIG. 1B show the converse profile and the left side of the fuel rib.

The top plate extensions that project laterally on each side of the rib form first and second "wings" 20 and 22, respectively, which lie in a common plane. At least one wing, here wing 22, includes a flange 24 that is angled down at about a 45° angle from the wings 20 and 22. As best seen in FIG. 2B, the included angle of the flange 24 to the wing 22 is, for this V8 engine, 135°. The space 26 between the rib 14 and the marginal edge 18 of the flange 24 forms a wire harness management channel, and the overlying wing 22 and flange 24 protect the wiring from interference during servicing and operation. The wings are also highly heat conductive, being of aluminum, so that the assembly assists in cooling the engine and the components related to the EFI and DIS systems operation. The slots 74 accommodate fastening bolts.

FIG. 1B is a view of the inventive assembly 10 of FIG. 1A that has been inverted to show the under side and more clearly delineate the longitudinal depending mid-rib 14. The rib is bored longitudinally to serve as the high pressure fuel supply manifold to the injectors, and includes a plurality of precision-milled injector bores 28 and lands 30 into which the fuel injectors 32 (shown in FIG. 2B) are seated. Note that the rib is continuous between the fuel injector bores, and the rib may be enlarged in width adjacent the plate 12 for a full length fuel supply bore 34. The orthogonal injector bores 28 communicate with the longitudinal fuel supply bore 34. The injectors are pressure seated in their respective bores 28, and the flats of the lands 30 assist in stabilizing the assembly when mounted on the cylinder head, the land flat area mating with the corresponding flat shoulders on the injectors, as the case may be for a particular engine head design (an example being best seen in FIG. 2B). Note the center line BCL of each bore 28 is canted with respect to the longitudinal axis of the fuel bore 34 The land 30 is machined into the bottom of the mid-rib at a complementary Angle G, so the injector bore is orthogonal to the land. In the example shown in this figure, the cant angle of the bore, BCL, and the land Angle G, is 12°. Each end of the fuel supply bore 34 is threaded 36 to receive the threaded fitting of the fuel supply line, the cross-over line and the terminal plug, respectively, as described in more detail with respect to FIG. 3.

One skilled in the art will appreciate that to further assist in wiring management, the underside of the wings 20, 22 and 24 may be fitted with one or more wiring bundle routing clips 64*a*, 64*b*, 64*c*, best seen in FIG. 1B, to secure the wiring bundles in proper place. Such clips assist in preventing the wiring bundles from migrating during use, due to engine vibration and air flow, into positions to interfere with other plumbing and hardware of the engine, and to prevent their chafing and potential failure. The clips will also assist service techs to properly route the wires for maximum clearance and heat relief.

FIG. 2A is an end elevation of the inventive assembly 10 of FIG. 1A slightly to the right of end-on to more clearly show the profile of the plate 12, the wings 20 and 22, the angled flange 24 and the right side of the fuel rib 14, enlarged 38 near the juncture with the plate for the fuel supply bore 34. Below the rib 14 is shown an exemplary retaining spring-arm clip 64*d* that is secured to the head by the bolt as shown. The clip arms have a contour that corresponds to the rib bulge for the fuel bore 34. The assembly rib is pressed downwardly in the spring clip and is retained by the upstanding arms that are shaped to conform to the outer surface of the rib to securely grip it. Typically, two or three clips may be used, spaced intermediate between the fuel injector bores 28. The assembly is released simply by pulling up on the two ends by gripping under the wings. In the alternative, to secure the inventive fuel rail assembly in place, bolts may be passed through slots 74 to engage bosses provided on the engine for conventional pipe-type fuel rails.

FIG. 2B is the near-end-on elevation of the inverted inventive assembly 10 of FIG. 1B showing the converse profile and the left side of the fuel rib 14. An exemplary injector 32 is shown exploded above the bottom side of the rib, and Arrow D shows the direction that the O-ring connector stud 40 seats in the injector bore 28. The injector nozzle 42 fits in the cylinder head, and the electronically actuated solenoid fuel valve assembly 44 is wired to the DIS (not shown) via lead 46. Included Angle E, shows the cant angle of the vertical center line of the mid-rib 14 to the angled wing 22, in this V8 engine example, 78°. The included Angle F shows the angle between the wing 22 and the flange 24, in this example 135°. The corresponding angle between the flange and the canted mid-rib is thus 33°.

Figure 3:
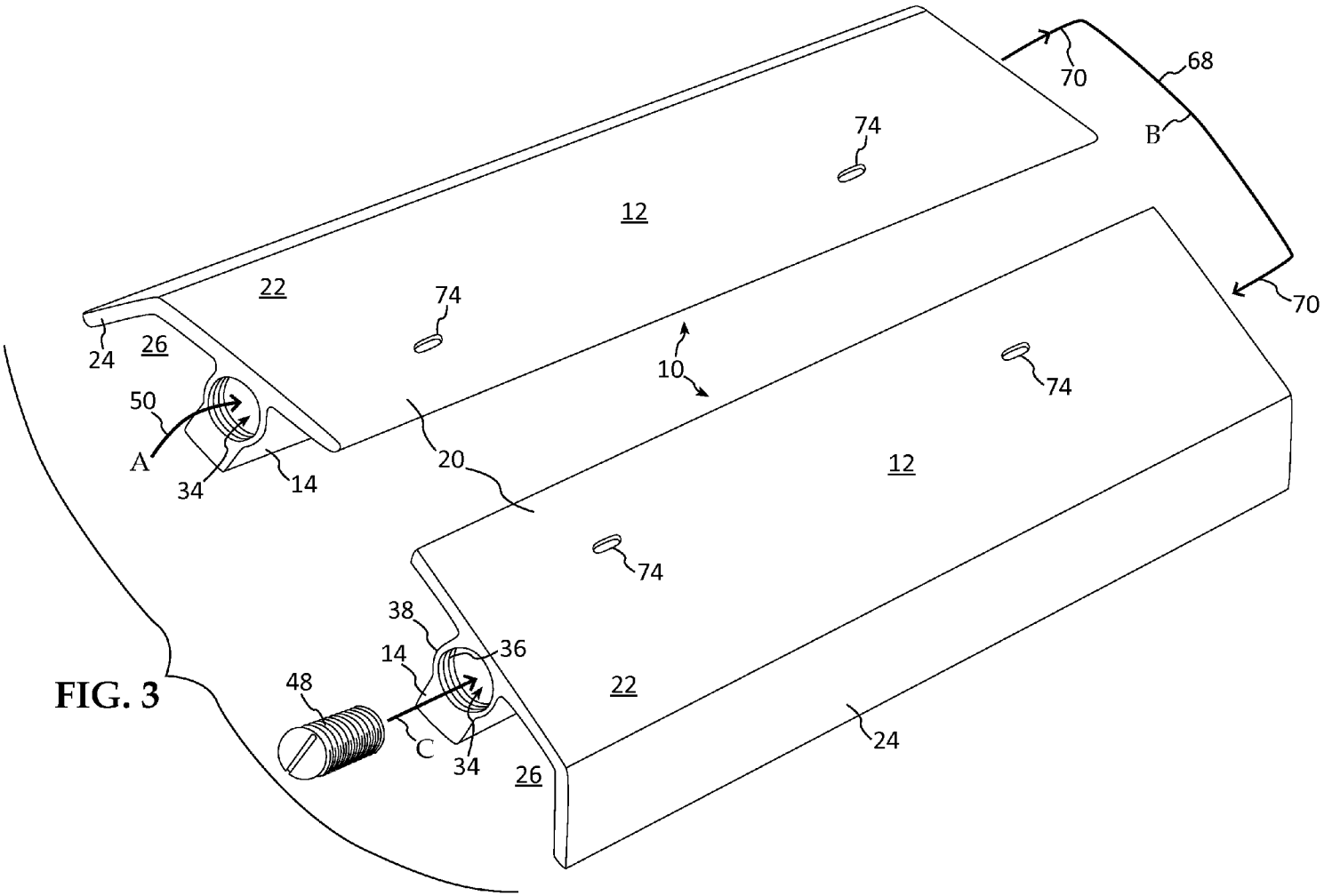
FIG. 3 is a ¾ elevated isometric view of a pair of the inventive fuel rail/harness protection assemblies in position as mounted on a V8 engine, the flanges on the outboard sides of the cylinder banks and the fuel feed path shown by arrows A-C.

FIG. 3 is an isometric elevated view, looking forward from the passenger side of a vehicle, of a pair of the inventive fuel rail/harness protection assemblies 10 in position as mounted on a V8 engine (not shown), the flanges 24 oriented on the outboard sides of the cylinder banks and the fuel feed path being shown by Arrows A and B. The plug 48 is inserted into the rear end of the passenger side inventive fuel rail assembly as shown by Arrow C. The bulkhead (firewall) of the engine compartment is to the left end of the assemblies, and the radiator/fan(s) to the right. The flexible inlet feed line is threaded into the fuel supply bore 34 of the left, driver's side, assembly at the rear, firewall-facing end of the engine as shown by Arrow A. A rigid or flexible crossover line 68 is threaded into the forward end of the left assembly bore, and routed into the forward end of the right assembly bore 34 as shown by Arrow B, which also indicates the fuel flow direction. At the back end of the right assembly, a plug 48 is threaded into the threads 38 of the bore 34. Fastening slots are shown at 74.

One skilled in the art will recognize that depending on engine orientation and clearance in the engine bay, the routing can be reversed, either side to side or front to back, as needed. In addition, in the preferred example shown in FIGS. 5 and 6, the fuel supply line can feed into the forward end of one of the inventive fuel rail assemblies via a "T" fitting. The preferred feed provides fuel to the two cylinder banks in parallel, rather than in series as shown in FIGS. 3 and 4.

Figure 4:
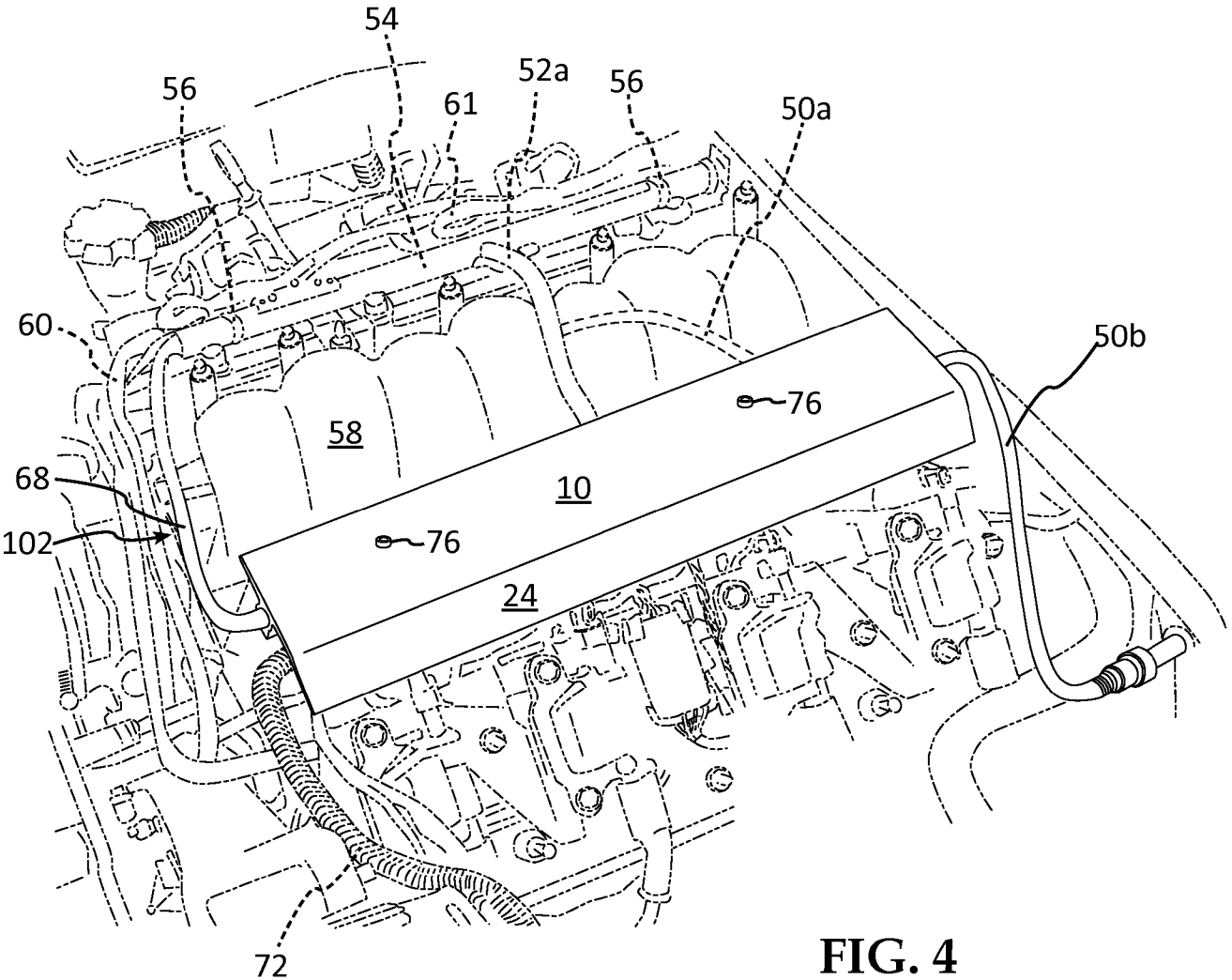
FIG. 4 is an isometric view, partly in schematic, showing a fuel rail/harness protection assembly mounted on the left (driver's) side bank of cylinders of a V8 engine, and a conventional, prior art, fuel rail with the exposed fuel feed, cross-over pipe and wiring shown in the background on the right (passenger) side bank of cylinders.

FIG. 4 is an isometric view from the driver's side of a vehicle showing on the passenger side cylinder bank (the upper half of the figure) a conventional fuel rail assembly 100 mounted on a V8 engine 102, comprising a flexible fuel supply line 50*a* connected to a rigid cross-over pipe 52 joining two fuel rails 54 (only the right side being shown in this view). A pair of hold-downs 56 secures each fuel rail in place to bosses provided on the engine. Note the rigid cross-over pipe crosses over and above the air intake manifold 58 about midway, fore and aft of the engine. Note also the several exposed wiring harness bundles 60 and 61 snaking along the engine underneath, alongside and below the fuel rails.

The lower half of FIG. 4 (in the foreground) shows the driver's side cylinder bank on which one of the pair of inventive fuel rail/wiring harness protective assemblies 10 has been installed in place of the conventional fuel rail assembly of the type shown in the upper portion (background) of FIG. 4. The inlet fuel line 50 is shown schematically re-routed to the rear end of the assembly 10 for inlet of fuel as shown by Arrow A (compare to FIG. 3). In addition, the mid-engine crossover pipe 52*a* has been replaced with a forward-end crossover pipe 68. Compare the location of the crossover pipe 52*b* with Arrow B in FIG. 3. The cap head screws 76 pass through the slots and secure the inventive fuel rail to the engine bosses.

This figure also shows the conventional fuel rail assembly is H-shaped in plan view, with the cross-over rigid pipe connecting the two rails at the fore-aft mid-point of the engine, and hindering lift-off/place-down access to the air intake manifold. In contrast, using the inventive assembly, the air intake manifold is not obstructed at its midpoint. It is also evident from this figure that when the passenger side inventive fuel rail assembly is used to replace the conventional fuel rail 54, the wiring bundles 60*a*, and 61 would be covered by the wings 20, 22 and flange 24. This is evident by noting the wiring bundle 60*b* is shielded by the wing in the foreground.

Although the mass of the inventive assembly, press fit onto from 3-6 injectors per bank (depending on the number of engine cylinders), helps to retain the inventive assembly in place, it is preferred to include brackets or screws for securing it to the head or the air manifold. Thus, one or more snap-in-place type friction bracket can be screwed to the head, as shown in FIG. 2A, or the bolts 76 used, as preferred.

Figure 5:
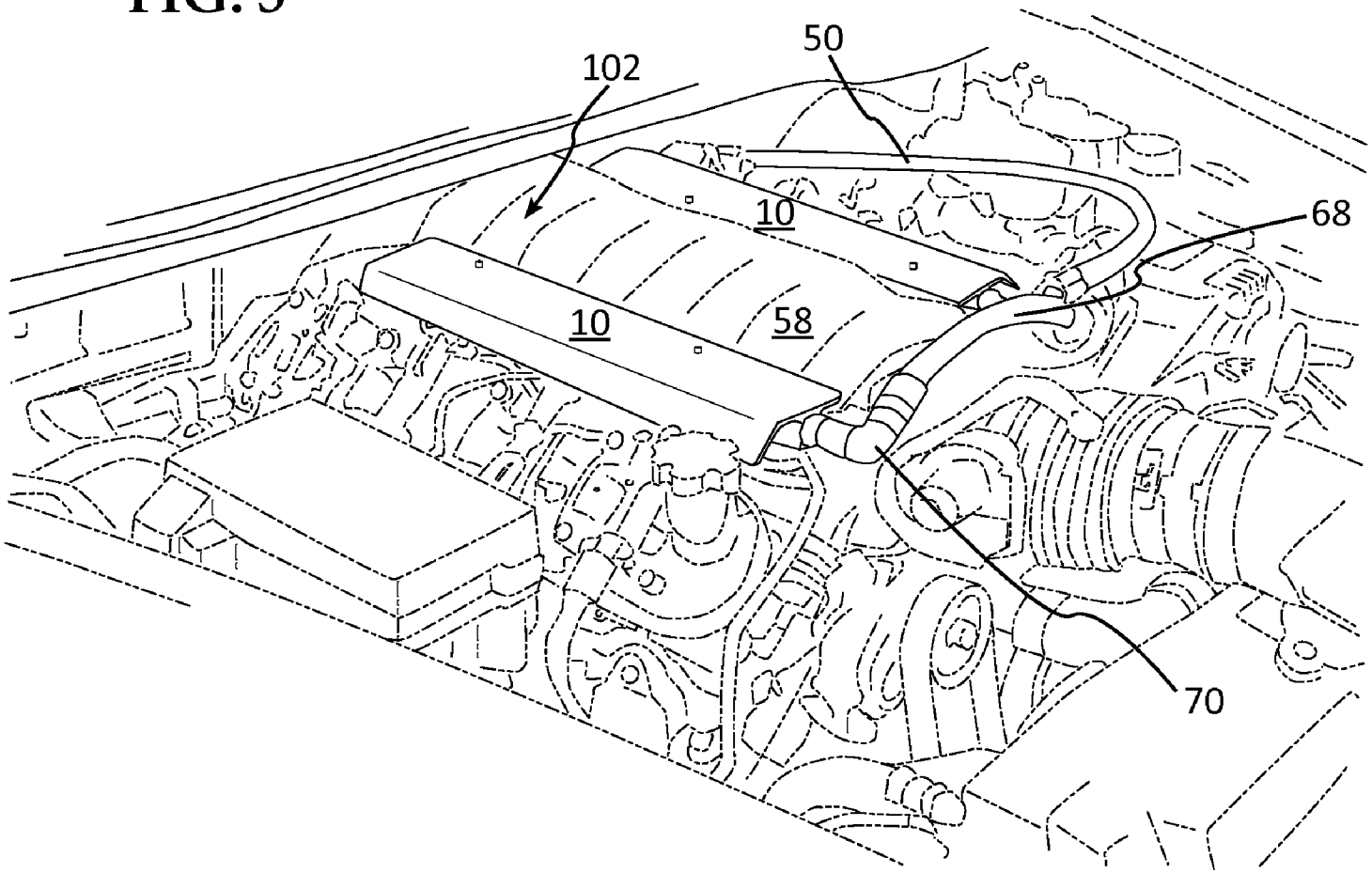
FIG. 5 is an isometric view from the front right side of the engine showing installation of both inventive fuel rail assemblies.
Figure 6:
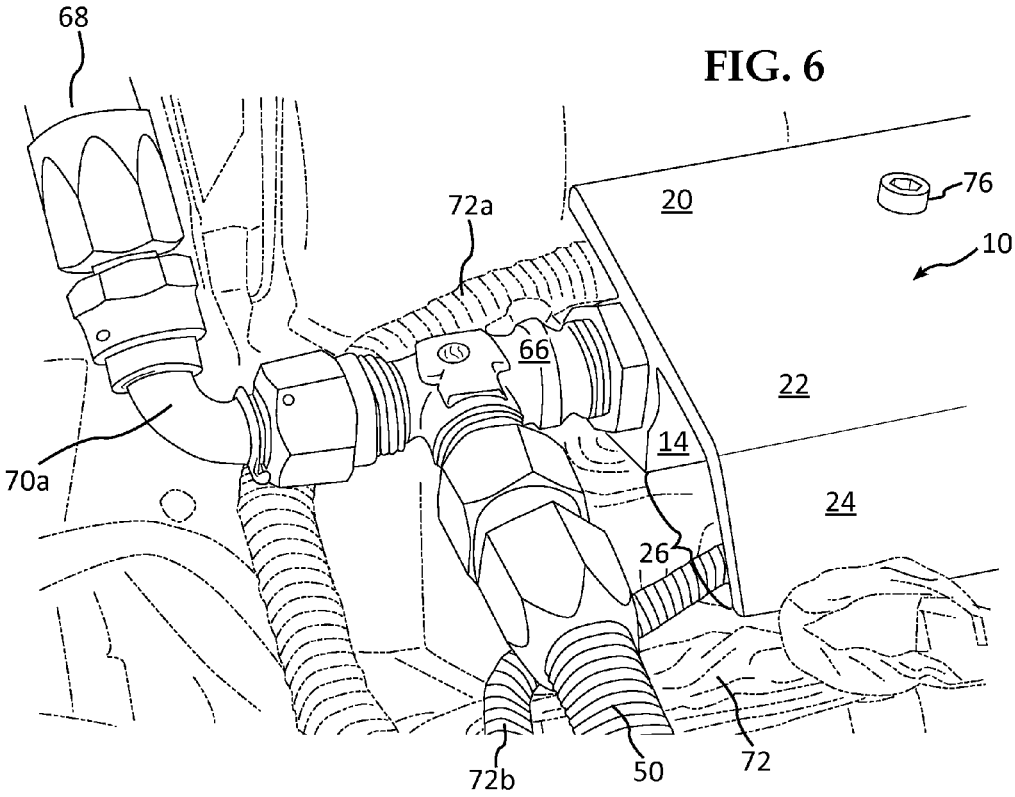
FIG. 6 is a close up of the fuel inlet line and cross-over fuel line "T" fittings as mounted to the forward end of the left (driver's) side inventive fuel rail module as mounted on the V8 engine of FIG. 5.
Figure 7:
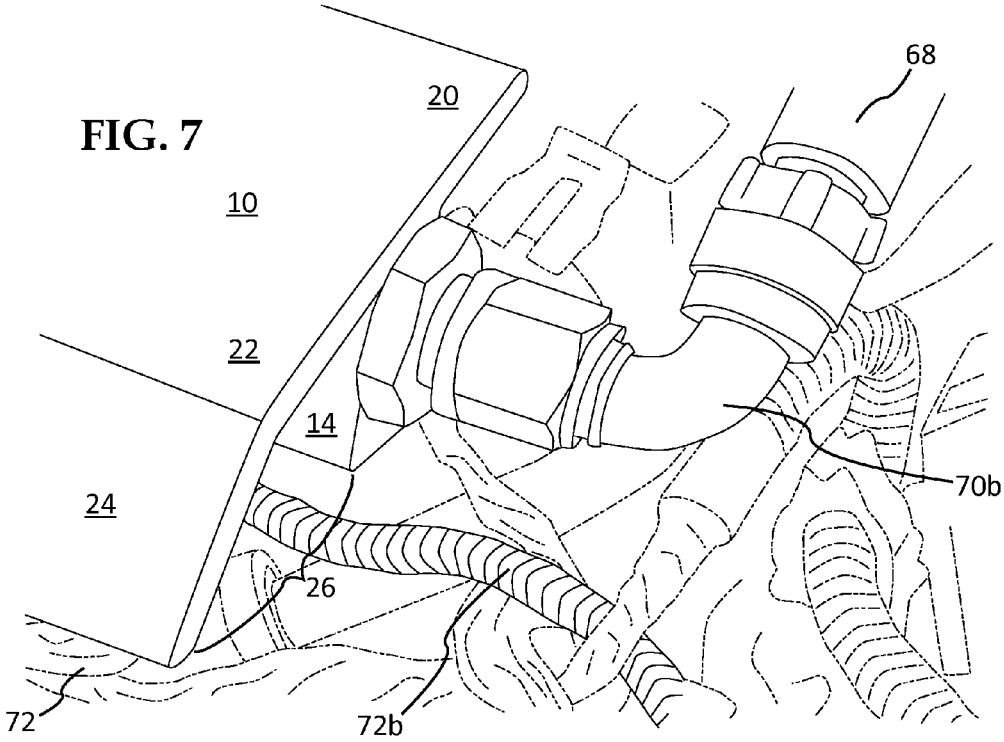
FIG. 7 is a close up of an elbow fitting showing connection of the cross-over line to the forward end of the inventive fuel rail module as mounted on the right (passenger) side of the V8 engine of FIG. 5.

FIGS. 5, 6 and 7 show the second, presently preferred, embodiment of the fuel line routing to a pair of inventive fuel rails as mounted in proper position on a V8 engine 102. In this embodiment, as best seen in FIG. 5, the inlet fuel line 50 is routed from adjacent the fire wall to a T-fitting 66, which is best seen in the close-up isometric view of FIG. 6. The T-fitting 66 is threaded into the forward end of the driver's side inventive fuel rail 10, seen in the background in FIG. 5, and close up in FIG. 6. The fuel bore in the rib 14 is closed at the back (firewall) end of the driver's side fuel rail with a plug 48 (not visible, but see FIG. 3). As seen in FIG. 6, the other arm of the T fitting 66 is connected to a rigid or flexible cross-over line 68 via a first elbow 70*a*, to connect to a second elbow fitting 70*b* (best seen in FIG. 7) at the forward end of the right (passenger side) fuel rail assembly 10 (in the foreground of FIG. 5 and at the left in FIG. 7). The back end of the passenger side inventive fuel rail fuel bore is also closed with a plug 48 (not visible, but see FIG. 3). It is important to note in these three figures that the wiring bundles 72, 72*a* and 72*b* are completely covered by the angled and flat wings 20, 22, 24 of the inventive assembly.

In addition, the robust wing and rib construction of the inventive fuel rail resists puncturing, far better than the relatively thinner tubes currently in use, and permits a wider range of fuel pressures to be used, particularly in supercharged and diesel engines. Thus the inventive fuel rail system is useful for gasoline, diesel, bio-diesel, alcohol-containing and racing fuels at higher pressures, above about 200 psi, than for pump gas.

Accordingly, the inventive fuel rail and wiring harness management assembly is characterized as an assembly for internal combustion engines having a pressurized electronic fuel injection system comprising: a planar plate, elongated in a first, longitudinal length, and having a pair of opposed, laterally extending wings, each of said wings has an exterior marginal edge, said wing edges being generally parallel to each other; at least one of the wings includes a flange extending at an angle downwardly relative to the plane of said plate; a rib projecting downwardly from the underside of the plate, the rib being disposed generally medially between the wing marginal edges and having a bottom surface spaced downwardly from the planar plate; the rib extends the longitudinal length of the plate and includes a longitudinal bore extending the length of the rib from a first, proximal end to a second, distal end, functioning as a fuel distribution manifold for supply of fuel under pressure to fuel injectors of the engine; the rib includes a plurality of bores extending from the rib bottom surface and intersecting the longitudinal fuel supply bore, the intersecting bores being sized for fuel injectors for the engine and disposed medial of the rib ends; and the flange, wing and rib defining at least one channel for routing and managing wiring associated with the injectors of the engine or ignition wires for the cylinders of the engine.

INDUSTRIAL APPLICABILITY

It is clear that the inventive fuel rail/wiring harness protector assembly, including fuel lines, injectors, end plug, an option clips, of this application has wide applicability to the engine field, and more particularly to the automotive industry. The system clearly provides advantages for fuel routing and wiring management. Thus, the inventive assembly has the clear potential of becoming adopted as the new standard for apparatus and methods of fuel delivery and wiring protection.

It should be understood that various modifications within the scope of this invention can be made by one of ordinary skill in the art without departing from the spirit thereof and without undue experimentation. For example, the wings and flange can have a wide range of designs to provide the functionalities disclosed herein. Likewise the fuel delivery rib may be sized to any particular engine, and the mode of securing the assembly to the head may include any convenient attachment mode(s) including clips, screws, bolts, flanges and brackets. The flange size, angle, and marginal shape may be varied to provide whatever amount of coverage and clearances may be needed for a particular engine. In addition, clips to retain wires in the wiring channel(s) may be provided for better management of wiring to maintain the wiring clear of other engine parts. The cross-over line, although preferred to be flexible, may be rigid pipe. This invention is therefore to be defined by the scope of the appended claims as broadly as the prior art will permit, and in view of the specification if need be, including a full range of current and future equivalents thereof.

The invention claimed is:

1. An improved fuel rail and wiring harness management assembly for internal combustion engines having a pressurized electronic fuel injection system comprising:

a) a planar plate, elongated in a first, longitudinal length, and having a pair of opposed, laterally extending wings, each of said wings has an exterior marginal edge, said wing edges being generally parallel to each other;

b) at least one of said wings includes a flange extending at an angle downwardly relative to the plane of said plate;

c) a rib projecting downwardly from the underside of said plate, said rib being disposed generally medially between said wing marginal edges and having a bottom surface spaced downwardly from said planar plate;

d) said rib extends the longitudinal length of the plate and includes a longitudinal bore extending the length of said rib from a first, proximal end to a second, distal end, functioning as a fuel distribution manifold for supply of fuel under pressure to fuel injectors of said engine;

e) said rib includes a plurality of bores extending from said rib bottom surface and intersecting said longitudinal fuel supply bore, said intersecting bores being sized for fuel injectors for said engine and disposed medial of said rib ends; and f) said flange, wing and rib defining at least one channel for routing and managing wiring associated with said injectors of said engine or ignition wires for said cylinders of said engine.

2. An improved fuel rail and wiring harness management assembly as in claim 1 wherein said planar plate and rib are unitary, being formed from extruded, cast or billet aluminum.

3. An improved fuel rail and wiring harness management assembly as in claim 2 wherein each end of said longitudinal fuel bore in said rib is threaded adjacent said ends to receive fuel lines or a plug.

4. An improved fuel rail and wiring harness management assembly as in claim 3 wherein said assembly includes a pair of plate and rib assemblies oriented generally parallel to each other, and connected at the same end of each said assemblies by a cross-over, pressurized fuel line connecting the two assemblies, and the end of at least one assembly includes a plug threaded into said fuel bore at an end opposite to the cross-over fuel line.

5. An improved fuel rail and wiring harness management assembly as in claim 4 wherein a first of the pair of said fuel rail assemblies includes a fuel feed line threaded into a first end of said fuel bore, said cross-over line is threaded into the second end of said assembly of each assembly of said pair, and the a plug is threaded into the first end of the second assembly of the pair.

6. An improved fuel rail and wiring harness management assembly as in claim 4 wherein a first end of each of said pair includes a plug threaded into their respective fuel bores, and said cross-over fuel line includes a T-fitting that has an input branch for connection to a fuel supply line.

7. An improved fuel rail and wiring harness management assembly as in claim 3 which includes fastening members selected from bolts passing through at least one wing and clips, to assist in securing said assembly to said engine.

8. An improved fuel rail and wiring harness management assembly as in claim 7 wherein at least one of said wings includes a pair of slots disposed adjacent said rib but not intersecting said rib, and said fastening members are cap screws.

9. An improved fuel rail and wiring harness management assembly as in claim 3 wherein said injector bores are unthreaded and precision machined to permit tight, fuel leak-free sealing, press-fitting of said assembly onto injectors mounted to said engine.

10. An improved fuel rail and wiring harness management assembly as in claim 9 wherein the center line of said injector bores are oriented at an angle to the longitudinal axis of said fuel supply bore.

11. An improved fuel rail and wiring harness management assembly as in claim 10 which includes an inclined notch comprising a flat machined at the bottom of said rib adjacent each injector bore to seatingly receive a shoulder of an injector, said notch being angled to match the angle of the injector fitting to said engine so that said injector bore center line is generally orthogonal to said flat.

12. An improved fuel rail and wiring harness management assembly as in claim 11 wherein said notch is disposed at an angle of about 12° to the bottom of said rib.

13. An improved fuel rail and wiring harness management assembly as in claim 3 wherein said flange is disposed at an angle with respect to said planar plate of approximately 135°.

14. An improved fuel rail and wiring harness management assembly as in claim 13 which includes from three to six intersecting fuel injector bores spaced along said rib.

15. An improved fuel rail and wiring harness management assembly as in claim 1 wherein said rib, seen in end elevation, is canted with respect to the plane of said lateral wings.

16. An improved fuel rail and wiring harness management assembly as in claim 15 wherein said cant angle is about 78°.

* * * * *